United States Patent [19]

Perkins

[11] 3,949,928

[45] Apr. 13, 1976

[54] CARTON CONSTRUCTION

[75] Inventor: William H. Perkins, Oxford, Ohio

[73] Assignee: Diamond International Corporation, New York, N.Y.

[22] Filed: Feb. 12, 1975

[21] Appl. No.: 549,190

[52] U.S. Cl. ..... 229/19; 229/9; 229/31 FS
[51] Int. Cl.[2] ..... B65D 5/38; B65D 13/06
[58] Field of Search ..... 229/31 FS, 32, 34, 9, 11, 229/8, 19, 20

[56] References Cited

UNITED STATES PATENTS

| | | | |
|---|---|---|---|
| 1,364,897 | 1/1921 | Smith | 229/32 |
| 1,668,234 | 5/1928 | Fancher | 229/9 |
| 2,214,813 | 9/1940 | Guyer | 229/31 FS X |
| 2,276,374 | 3/1942 | Derman | 229/32 |
| 3,091,381 | 5/1963 | Conescy | 229/31 FS |
| 3,189,248 | 6/1965 | Roccaforte | 229/31 FS |
| 3,204,851 | 9/1965 | Rouder et al. | 229/9 X |
| 3,761,009 | 9/1973 | Rosenburg, Jr. | 229/9 X |

*Primary Examiner*—Davis T. Moorhead
*Attorney, Agent, or Firm*—Karl W. Flocks

[57] ABSTRACT

Carton construction comprising an outer sleeve member and at least one inner tray member adapted to be inserted within the outer sleeve member to provide an assembled container and closure. Each of the inner and outer members being formed from separate blanks of pasteboard or like material provided with a finished and/or printed surface on one side of each of the blanks and an unfinished surface on the opposite side of the blanks. Each of the inner and outer members in the respective assembled condition thereof having no exposed or visible raw edges along the exterior thereof.

8 Claims, 8 Drawing Figures

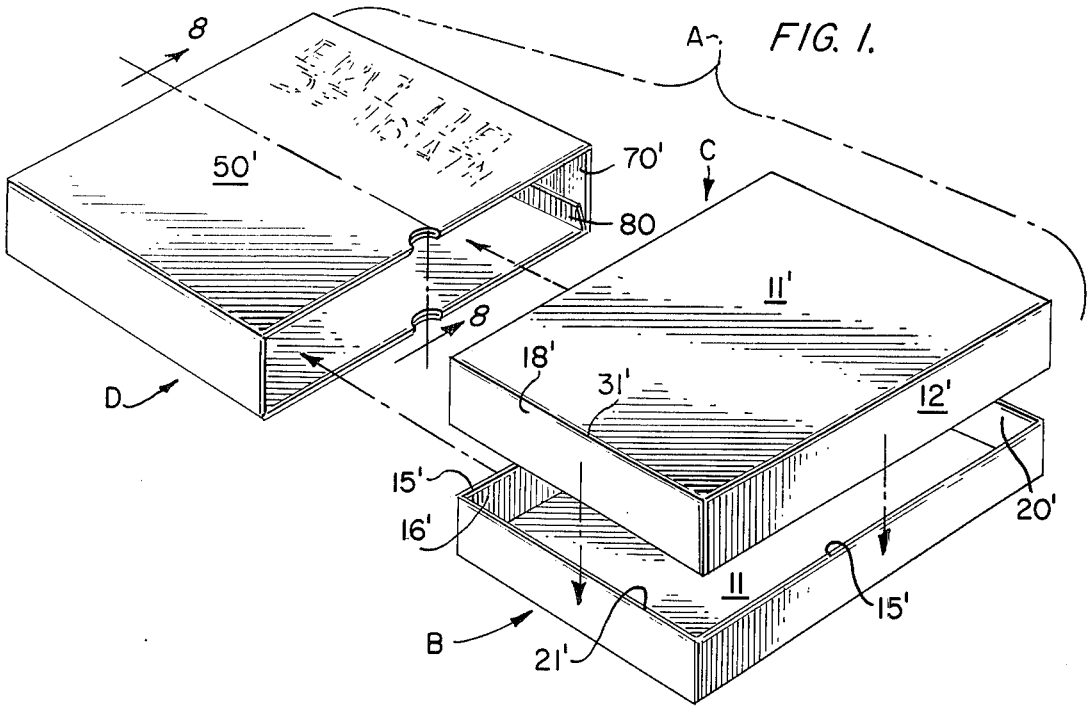
FIG. 1.
FIG. 2.
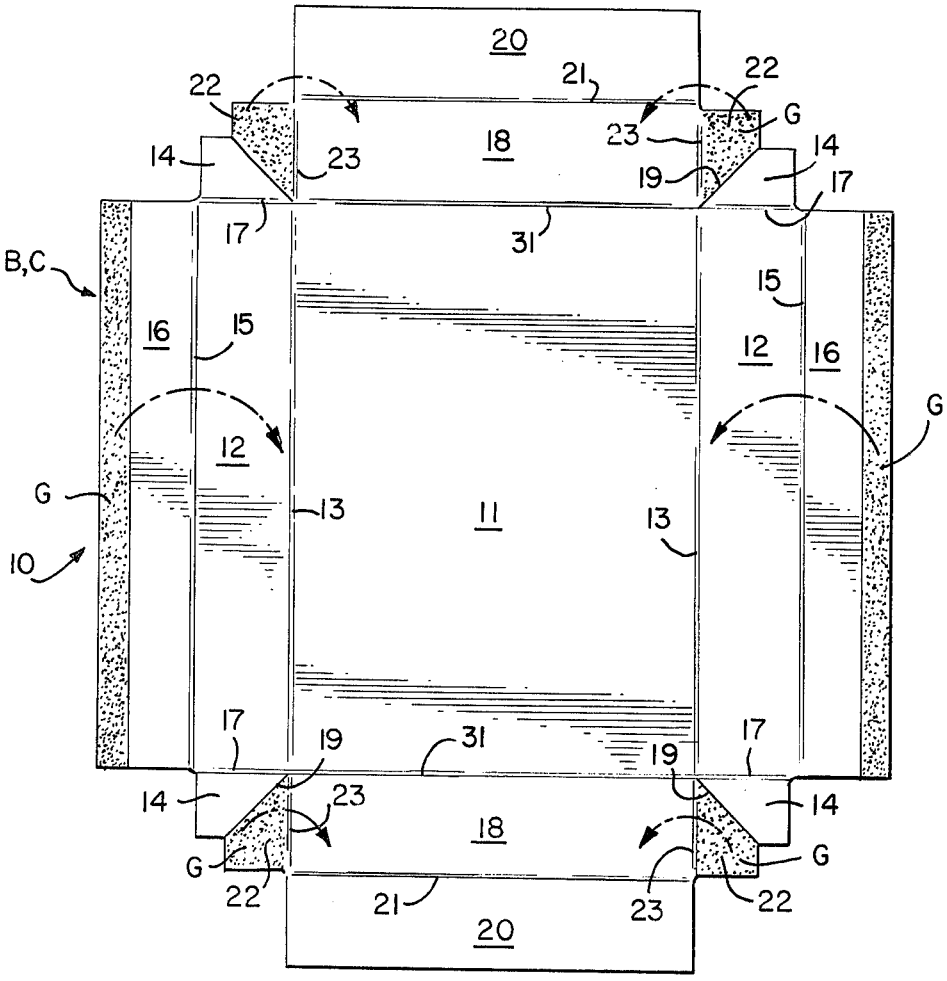

CARTON CONSTRUCTION

BACKGROUND OF THE INVENTION

This invention relates to new and improved storage container construction of pasteboard or like material. More particularly, this invention relates to such container construction for storage of components of indoor games, jigsaw puzzles, and the like, which components may be periodically placed into and removed from the container thereof. Such container construction are known to be subjected to frequent handling and consequently must be sturdy. Moreover, as such container construction is stored in the home, it is frequently desirable that such construction be harmonious with normal household furnishings and therefore inconspicuous when put away, but yet readily available for use as may be desired.

SUMMARY OF THE INVENTION

Accordingly, it is an object of this invention to produce carton construction in which substantially all wall portions of each member of the carton construction in assembly is at least two ply to provide adequate strength thereto.

It is another object of this invention to provide carton construction in which substantially all exposed or visible external edge portions thereof are folded inwardly so that raw edges of the material of construction are hidden.

It is a further object of this invention to provide carton construction which is formed with improved joints at intersections of the wall portions thereof.

BRIEF DESCRIPTION OF THE DRAWINGS

The above and other objects and advantages of the present invention will become apparent from the following specification when read in conjunction with the accompanying drawings, in which:

FIG. 1 is an exploded view in perspective of three members of container construction in erected and assembled condition according to the present invention;

FIG. 2 is a plan view of a blank for making either of two members of the container construction in FIG. 1;

DETAILED DESCRIPTION OF THE DRAWINGS

Figure 3:
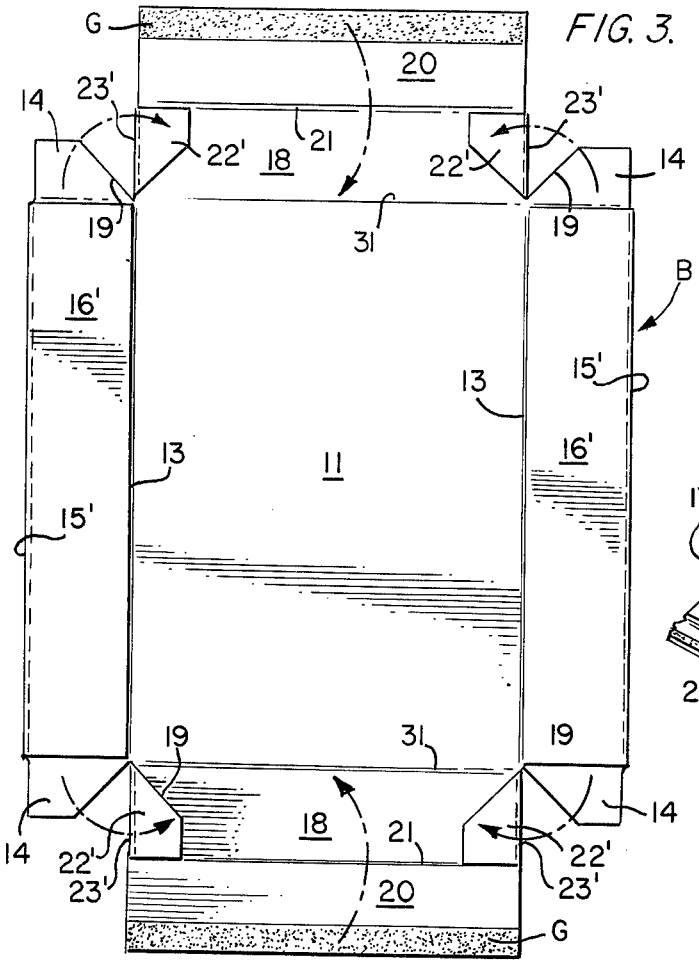
FIG. 3 is a plan view of the blank of FIG. 2 with portions thereof folded 180° into the interior of the member and secured to the inner face of adjacent portions.

Referring now to the drawings in detail, and more particularly to FIG. 1, there is illustrated an exploded view of a carton construction A which, according to the present invention, includes a container tray B, a tray cover C, and a container sleeve D. The container tray B as shown in FIG. 1 is in its article receiving position. Tray cover C may be and is shown to be identical in construction to that of tray B except that it must be slightly larger than tray B so that it may be telescopically lowered over tray B in the direction of the downwardly directed arrows. The subassembly of cover C and tray B may then together be inserted into container sleeve D in the direction of arrows directed toward northwest in FIG. 1, and when thus completely assembled sleeve D may be turned on end and placed, for example, on a book shelf.

Figure 4:
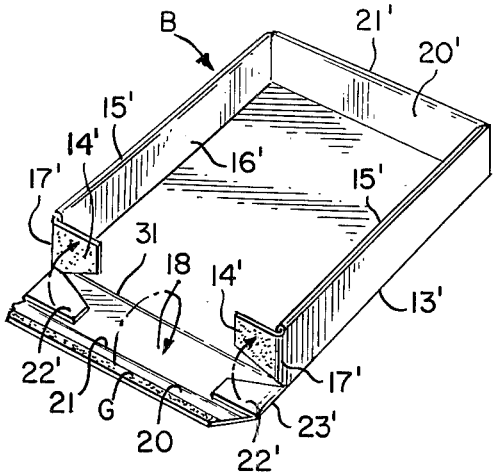
FIG. 4 is a top view in perspective of the blank of FIG. 3 advanced to erection and assembly of all walls except one of the carton member.
Figure 5:
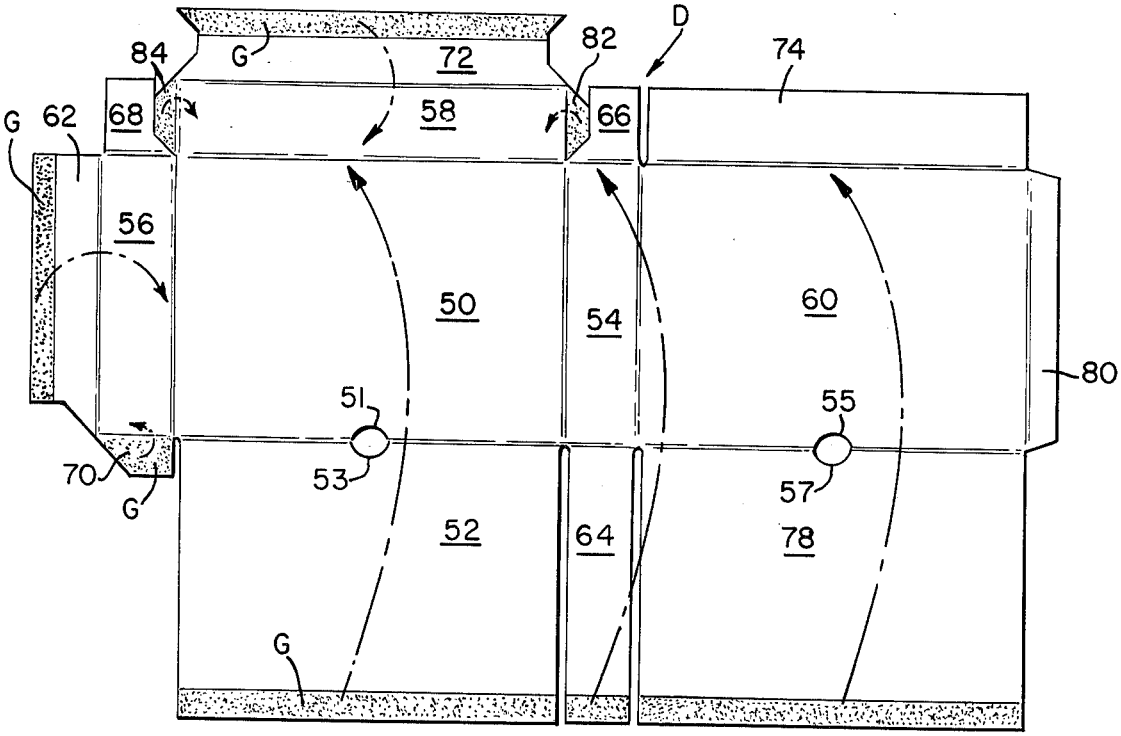
FIG. 5 is a plan view of a blank for making the third member of the container construction in FIG. 1.

Looking now to FIGS. 2, 3 and 4, there is illustrated first in FIG. 2 a blank B,C for constructing either container tray B or tray cover C of FIG. 1. Since these members are identical in construction except for size it is considered sufficient to describe one for the both. Consistent with the general practice and terminology of the carton manufacturing industry, wherein the inner surface of a carton is not or may not be lined or finished and is referred to as the bottom liner surface, and the outer surface of a carton is lined or finished and is referred to as the top liner surface, FIG. 2 shows the inner surface or bottom liner of the tray or cover which will be formed therefrom. To distinguish bottom liner surfaces and edges from corresponding surfaces and edges unprimed reference numerals are used in FIGS. 2–4 to designate bottom liner surfaces and edges, whereas primed reference numerals are used in FIGS. 3 and 4 to designate top liner surfaces and edges. Similar numbers primed and unprimed are used herein to designate surfaces or edges on opposite sides of a common structural piece.

Referring now to FIGS. 2, 3 and 4 in detail, a blank B is seen to have a bottom panel 11 with main side wall panels 12 integral therewith along opposite fold lines or edges 13 and auxiliary side wall panels 16 extending from main side wall panels 12 along fold lines or edges 15. On opposite ends of each main side wall panel extend end flaps 14 along fold line or edge 17. On opposite ends of bottom panel 11 are fold lines or edges 31 from which main end wall panels 18 extend. Each main end wall panel 18 includes an auxiliary end wall panel 20 along a fold line or edge 21 and side flaps 22 along fold line or edge 23. The end flaps 14 and side flaps 22 are formed separate and independent of each other by cut line 19.

To facilitate handling in shipment of large quantities of carton members to users, the cartons must be shipped in flat or nearly flat condition, yet such carton members should be shipped in at least partially assembled condition for the convenience of the user. To this end, adhesive G is applied in the stippled areas on bottom liner surface of auxiliary side wall panels 16 and side flaps 22, after which auxiliary side wall panels 16 are folded 180° along fold lines 15 and adhered to main side wall panels 12 and side flaps 22 are folded 180° along fold lines 23 and adhered to main end wall panels 18, as seen in FIG. 3, which shows the degree of assembly of carton member B when it is shipped to the user thereof. In completing the assembly of tray member B for use according to the present invention, each main end wall panel 18 is folded 90° along fold line 31 each end flap 14 is folded 90° along fold line 17, after which main side wall panels 12 together with auxiliary side wall panels 16′ and end flaps 14 are turned 90° along fold line 13, as illustrated in FIGS. 3 and 4. Adhesive applied to outer or top liner surface of either end flap 14′ or side flap 22′ will provide a strong bond between top liner surfaces 14′ and 22′ when brought in contact with each other. Thereafter, to complete the assembly of tray member B, auxiliary end wall panels 20 are folded 180° along fold line 21 with adhesive G applied to the bottom liner surface thereof if desired. In any event, auxiliary end wall panel 20 is folded along fold line 21 and pressed against bottom liner surfaces of end flaps 14 and of main end wall panels 18. As noted above, container cover C because of its similarity to tray B will be assembled in similar fashion.

It is clear in FIGS. 1 and 4 that as assembled and erected tray B and cover C will have only outer or top liner surfaces exposed to the exterior thereof. Moreover, only folded edges will appear along the exterior of tray B and cover C. All raw edges are turned into the interior of the tray B and cover C so that only folded edges 13′, 31′, 17′, 23′, 15′ and 21′ appear along the exterior of tray B and cover C. In this manner, a carton member B or C is provided which is neat in appearance; reinforced and sturdy along all surfaces except at the bottom panel 11; securely joined at intersections of side wall and end wall portions. In this regard, each intersection of wall portions of tray B, for example, is provided with an end flap 14 and a side flap 22 which are separate and independent of each other and which joint is formed by folding one such flap 180° and adhering it bottom liner to bottom liner against a main wall panel, then the other of such flap is adhered top liner to top liner against the one such flap.

Referring now to FIGS. 5, 6, 7 and 8 in detail, a blank D is seen to have along a bottom liner surface a first main panel 50 having second main panel 54 integral therewith along one edge, a third main panel 60 integral with second main panel 54 and an assembly flap 80 integral with third main panel 60 along edges parallel to the edge between panels 50 and 54. On the side of panel 50 opposite to panel 54 extends a fourth main panel 56 with an auxiliary or reinforcement panel 62 integral therewith along a fold line. The blank D further includes auxiliary or reinforcement panels 52, 64 and 78 extending from lower edges of main panels 50, 54 and 60, respectively, and integral therewith and an auxiliary or reinforcement panel 74 along the upper edge of main panel 60. Along the upper edge of main panel 50 is an additional main panel 58 with trapezoidal end flaps 82,84 extending from opposite ends thereof. Extending along the top edge of main panel 58 is an auxiliary or reinforcement panel 72 provided at opposite ends thereof formed with trapezoidal cutouts or notches adjacent to end flaps 82 and 84, which cutouts are generally congruent with but facing in a direction opposite to the respective flaps 82 and 84 adjacent thereto. At the upper edges of main panels 54 and 56, respectively, extend foldable flaps 66 and 68 formed by cutting at least along two sides of trapezoidal flaps 82 and 84. Main panel 56 is also provided at its lower end with a foldable flap 70. Additionally, blank D is formed with notches or cutouts 51, 53, 55 and 57 along adjacent sides of main panels 50 and 52 and main panels 60 and 78, respectively.

Figure 6:
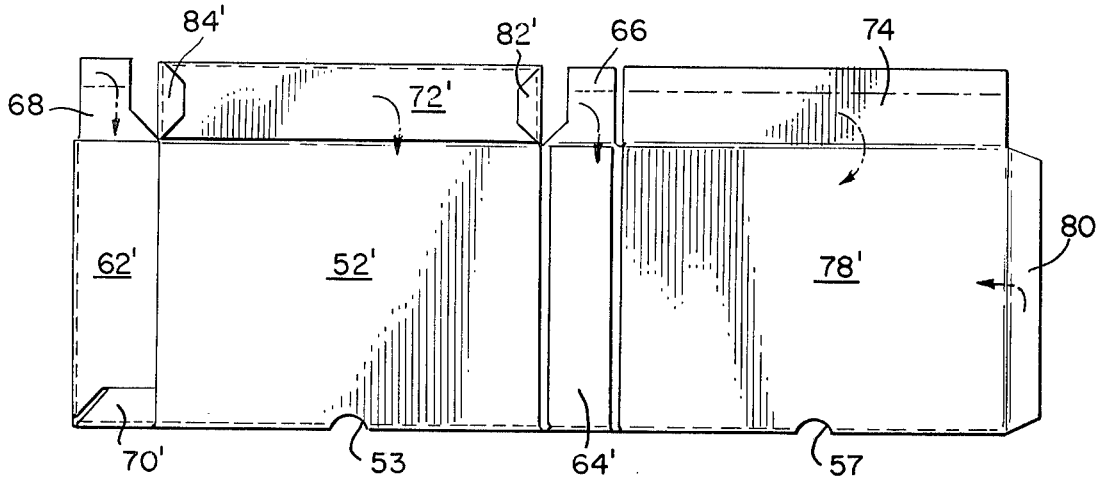
FIG. 6 is a plan view of the blank of FIG. 5 with portions thereof folded 180° into the interior of the member and secured to the inner face of adjacent portions thereof.

Sleeve D is partially assembled for the convenience of the user and to facilitate handling in shipment it is assembled only to the point where it may be shipped in flat condition as seen in FIG. 6. To facilitate assembly, adhesive is applied to the areas stippled or designated G in FIG. 5 and as auxiliary panels 52,64 and 78 are folded 180° about their fold lines they are adhered to main panels 50, 54, and 60, respectively, with top liner surfaces 52′, 64′ and 78′, respectively, in view in FIG. 6. The partially assembled form of blank D also includes folding auxiliary panel 72 and end flaps 82 and 84 180° about their respective fold lines and thereafter adhered to main panel 58 with top liner surfaces of end flaps 82′ and 84′ fitting in the cutouts at opposite ends of auxiliary panel 72′ as seen in FIG. 6. Auxiliary panel 62 and foldable flap 70 are seen to each have at least one side formed along the extension of a common side and of additionally parallel sides at opposite ends of the common side so that when auxiliary panel 62 and foldable flap 70 are turned in at 180° and adhered to main panel 56 no overlapping occurs between the surfaces of auxiliary panel 62′ and foldable flap 70′ as seen in FIG. 6, at which time the partially assembled carton member D is ready for shipment.

Figure 7:
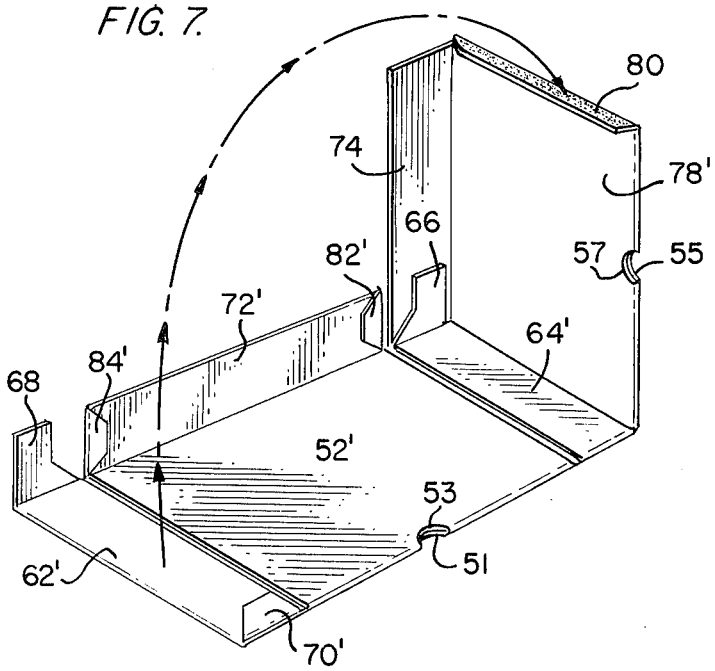
FIG. 7 is a top view in perspective of the blank of FIG. 6 advanced to a further stage for erection and assembly of the carton member.
Figure 8:
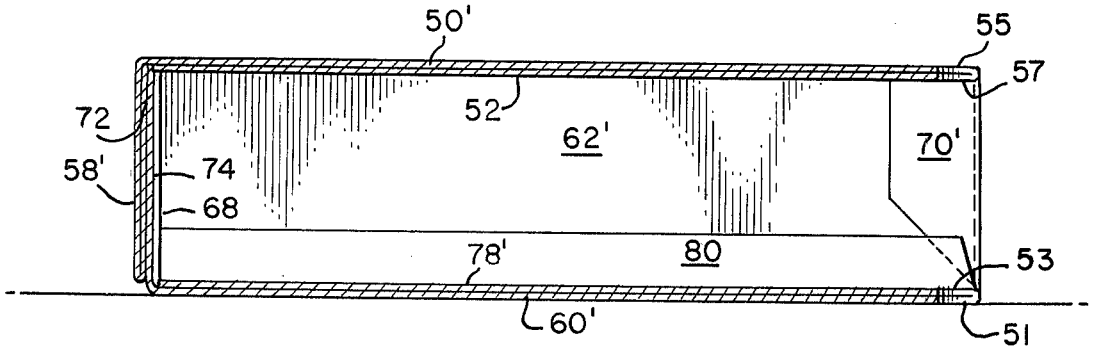
FIG. 8 is a view taken along the plane 8—8 through a vertical section of the carton member in FIG. 1.

When the user is ready to erect and completely assemble sleeve D foldable flaps 66 and 68 are turned up 90° about the respective fold lines thereof, auxiliary panel 74 is turned in at 90°, main panel 58 is turned in at 90° with auxiliary panel 72′ and end flaps 82′ and 84′ attached thereto as seen in FIG. 7. Main panel 60 is turned up 90° with auxiliary panel 78′ attached thereto as seen in FIG. 7 and with auxiliary panel 74 on the exterior of foldable flap 66. Adhesive applied to the outer or top liner surface of foldable flap 66 will then adhere same to auxiliary panel 74. Next panels 50, 52, 58, 72, 56, 62 are together raised 90° about the fold line between main panel 50 and main panel 54 with adhesive applied to the top liner surfaces 82′, 72′ and 84′ which are then affixed against the outside of panel 74 to secure same together. Next foldable flap 68 is folded in against panel 74 and adhered thereto in mirror image to foldable flap 66 leaving only surfaces 62′ and 70′ to be attached. Assembly of sleeve D is completed by tucking assembly flap 80, having adhesive applied to the top liner surface thereof against the adjacent portions of top liner surfaces of auxiliary panel 62′ and flap 70′ pressed thereagainst as seen in FIGS. 1 and 8.

The completely assembled sleeve D comprises a member in which each wall panel is of at least two ply and all external edges are folded so that no raw edges are visible except for the cutouts at 51, 53, 55, 57.

With the carton members B, C and D assembled together in which articles of a game, for example, are placed into tray B and cover C lowered thereover as suggested in FIG. 1, the members B and C may then be together slipped into sleeve D providing a carton construction having no raw edges exposed to view except at the notches 51, 53, 55, 57 which facilitate separation of the members. Moreover, pasteboard containers of very sturdy construction are thus provided.

It will be obvious to those skilled in the art that various changes may be made without departing from the scope of the invention and the invention is not to be considered limited to what is shown in the drawings and described in the specification.

What is claimed is:

1. A tray member suitable for containing articles therein in combination with an outer sleeve member into which said tray member is adapted to be inserted, said tray member comprising a bottom panel having pairs of opposite side edges and opposite end edges, an outer side wall panel extending upwardly from said bottom panel and integral therewith along each of said side edges, an outer end wall panel extending upwardly from said bottom panel and integral therewith along each of said end edges, each of said outer side wall panels having an upper edge and opposite end edges, each of said outer end wall panels having an upper edge and opposite side edges, each of said outer side wall panels further having an inner side wall panel integral therewith along said upper edge thereof and opposite end flaps integral therewith along said opposite end edges thereof, each of said outer end wall panels further having an inner end wall panel integral therewith along said upper edge thereof and opposite side flaps integral therewith along said opposite side edges thereof, said end flaps of each of said outer side wall panels being formed as an independent and separate piece apart from an adjacent side flap on said inner end wall panels, one of each adjacent end flap and side flap being folded 180° along the edge along which it is integral with an outer side or end wall panel and secured to an inner surface of said outer side or end wall panel, the other of each adjacent end flap and side flap being folded 90° along the edge along which it is integral with an outer side or end wall panel and secured to said adjacent flap along confronting surfaces thereof, said inner side and end wall panels each being folded inwardly 180° along the upper edges of the outer side and end wall panels, respectively, whereby said tray in its assembled condition has no exposed or visible raw edge along the exterior thereof, said outer sleeve member comprising a plurality of wall panel portions and of which each panel portion is formed of at least two-ply thickness with all exposed or externally visible edges thereof being folded and thereby showing no raw cut edges, said combination with said tray member inserted in said outer sleeve member may be adaptable to being placed on a shelf in a position on an end with the bottom panel of said tray extending vertically, said outer sleeve member in the storage condition of said combination including a generally elongated opening which may be directed toward the back of a book shelf and a generally elongated wall section opposite to said opening, and said wall section being finished along its exterior surface as a facsimile portion of a book cover.

2. The tray member of claim 1 in combination with a cover member adapted to be placed over said tray in telescoped fashion, said cover being identical in construction to that of said tray, but of slightly greater dimension.

3. The combination of claim 1 wherein prior to inserting said tray member into said outer sleeve member for storage said tray member is inserted in telescoped fashion into a cover member, said cover member being identical in construction to that of said tray, but of slightly greater dimension.

4. A blank for forming a container sleeve member comprising a bottom liner surface on which is provided a first main panel, a second main panel integral with said first main panel along a first edge, a third main panel integral with said second main panel along a second edge, an assembly flap integral with said third main panel along a third edge, a fourth main panel integral with said first main panel along a fourth edge on the side opposite to said second main panel, a reinforcement panel integral with said fourth main panel along a fifth edge or fold line, all of said edges being generally parallel to each other, said blank further including auxiliary panels extending from lower edges of said first, second and third main panels, a fifth main panel integral with and extending along an upper edge of said first main panel, an auxiliary panel extending along the upper edge of said third main panel, a reinforcement panel extending along the upper edge of said fifth main panel, said fifth main panel having trapezoidal end flaps extending from opposite ends thereof, said reinforcement panel having trapezoidal cutouts at opposite ends thereof in which said end flaps may be received, foldable flaps extending along upper edges of said second and fourth main panels and formed by cutting at least along two sides of said trapezoidal end flaps, and a foldable flap extending from the lower end of said fourth main panel.

5. The blank as defined in claim 4 wherein notches are formed along sides of said first and third main panels and said auxiliary panels extending from said first and third main panels.

6. The blank as defined in claim 5 wherein said foldable flap extending from the lower end of said fourth main panel and said reinforcement panel integral with said fourth main panel each include edge portions formed along a common line whereby said edge portions will be complementary to each other when folded along side each other in a commmon plane.

7. A container sleeve member comprising five main panels, each of which is reinforced by at least a second layer of material folded and lapped over each of said five main panels to provide at least a double thickness of material, each of said five main panels being generally rectangular in shape and including portions folded along each edge of each of said panels so that raw edges will not be visible along the exterior thereof, one of said main panels including a first extension along one edge thereof and a second extension along a second edge adjacent to said first edge, said first and second extension including portions formed along a common line with said portions extending alongside each other in complementary angle portions against said one of said main panels in the assembled condition of said sleeve.

8. The sleeve member as defined in claim 7 wherein a second one of said main panels is provided with folded extensions on opposite ends thereof and an additional folded extension on an additional side thereof, said additional folded extension being provided with cutouts on opposite ends thereof complementary to said folded extensions on opposite ends of said second one of said main panels whereby in the assembled condition said extensions of said second one of said main panels are folded thereagainst without overlap between either of said end extensions and said additional folded extension.

* * * * *